US005189455A

United States Patent [19]

Seim

[11] Patent Number: 5,189,455

[45] Date of Patent: Feb. 23, 1993

[54] PROCESSOR HAVING MEANS FOR INDICATING AN ERROR IN AN OPERATING CONDITION

[75] Inventor: April M. Seim, Spencerport, N.Y.

[73] Assignee: Eastman Kodak Company, Rochester, N.Y.

[21] Appl. No.: 772,516

[22] Filed: Oct. 7, 1991

[51] Int. Cl.[5] ..... G03D 13/00

[52] U.S. Cl. ..... 354/297; 354/324; 354/298; 340/309.3; 340/331; 340/520; 340/825.5

[58] Field of Search ..... 354/297, 298, 324, 317; 340/505, 519-521, 825.05, 825.36, 825.16, 825.17, 945, 973, 309.3, 331, 825.5; 355/206, 208

[56] References Cited

U.S. PATENT DOCUMENTS

| | | | |
|---|---|---|---|
| 4,151,514 | 4/1979 | Haynes | 340/286 |
| 4,401,971 | 8/1983 | Saito et al. | 340/519 |
| 4,498,075 | 2/1985 | Gaudio | 340/525 |
| 4,568,935 | 2/1986 | Phillips et al. | 340/825 |
| 4,635,030 | 1/1987 | Rauch | 340/519 |
| 4,845,483 | 7/1989 | Negishi | 340/825 |
| 4,857,918 | 8/1989 | Nukushina et al. | 430/870 |
| 4,994,837 | 2/1991 | Samuels et al. | 354/299 |
| 4,994,840 | 2/1991 | Hall et al. | 354/324 |
| 5,023,631 | 6/1991 | Negishi et al. | 355/206 X |
| 5,027,789 | 7/1991 | Lynch | 126/116 A |
| 5,059,996 | 10/1991 | Bailey et al. | 354/317 |

*Primary Examiner*—W. B. Perkey
*Assistant Examiner*—D. Rutledge
*Attorney, Agent, or Firm*—Frank Pincelli

[57] ABSTRACT

A processor for x-ray film includes stations wherein a latent image on the film is developed, fixed, washed and dried. Sensors detect operating conditions in the stations, and when a failure is detected in an operating condition, a lamp and alarm are energized in a predetermined sequence to signal an operator that a particular error exists.

4 Claims, 2 Drawing Sheets

PROCESSOR HAVING MEANS FOR INDICATING AN ERROR IN AN OPERATING CONDITION

BACKGROUND OF THE INVENTION

The present invention relates to an improved processor for photosensitive material wherein a plurality of operating conditions are sensed and signals are provided to an operator in response to detecting a failure in the operating conditions.

U.S Pat. No. 4,994,840, issued Feb. 19, 1991 in the names of D. O. Hall and B. R. Muller relates to an apparatus for processing a photosensitive material, such as a sheet of x-ray film. The apparatus of this patent has a processing unit with a vessel for retaining a processing fluid. Submerged in the processing fluid of the vessel is a processing device having a chamber through which the film travels during processing. Apparatus of this kind can be manufactured and sold at a relatively low cost. While low cost processors are desirable in many applications, the need to minimize manufacturing costs has limited the application of some features and devices from such processors. For example, low-cost film processors may have no devices for detection of error conditions, such as by failed parts of the apparatus. This makes it difficult for the processor operator to determine the cause of a failure and complicates service of such processors.

U.S. Pat. No. 4,994,837 issued Feb. 19, 1991 in the names of J. T. Samuels and R. D. Ellsworth for a processor with temperature responsive film transport lockout. This patent discloses a more expensive film processor incorporating a microcomputer coupled to sensors of various kinds for detecting operating conditions and to apparatus controlled by the microcomputer in response to detection of certain conditions. By incorporating microprocessors into low-cost processors, it is possible to monitor various systems or subsystems in the processor to detect error conditions. However, it is expensive to use a plurality of indicator lamps with each lamp being dedicated to indicate one specific error that has been detected. While such may be acceptable for more expensive processors, it is very desirable to reduce the number of indicator lamps or other signalling devices used for signalling the operator when each of a plurality of error conditions exist.

SUMMARY OF THE INVENTION

An object of the invention is to signal failure of one or more operating conditions in a way which is sufficiently inexpensive for use in low-cost film processors, and to minimize the parts required without interfering with the operator's ability to determine the error conditions even when multiple errors exist. The present invention is applicable to a processor for developing latent images on a photosensitive material, particularly a low-cost processor of this kind. The processor has at least one processing station wherein a processing fluid engages the material and a drying station wherein material is dried. Means are provided for sensing a plurality of operating conditions in the stations and detecting a failure in the operating conditions. A lamp is used for signalling error conditions. The improvement of the invention comprises control means coupled to the lamp and to the sensing means. The control means is effective to turn the lamp on and off one or more times in response to the sensing means detecting a failure in the operating conditions, with the number of times the lamp is turned on and off being related to the particular failure detected by the sensing means. The control means turns the lamp on and off a different number of times for each of the operating conditions, in accordance with a predetermined arrangement.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
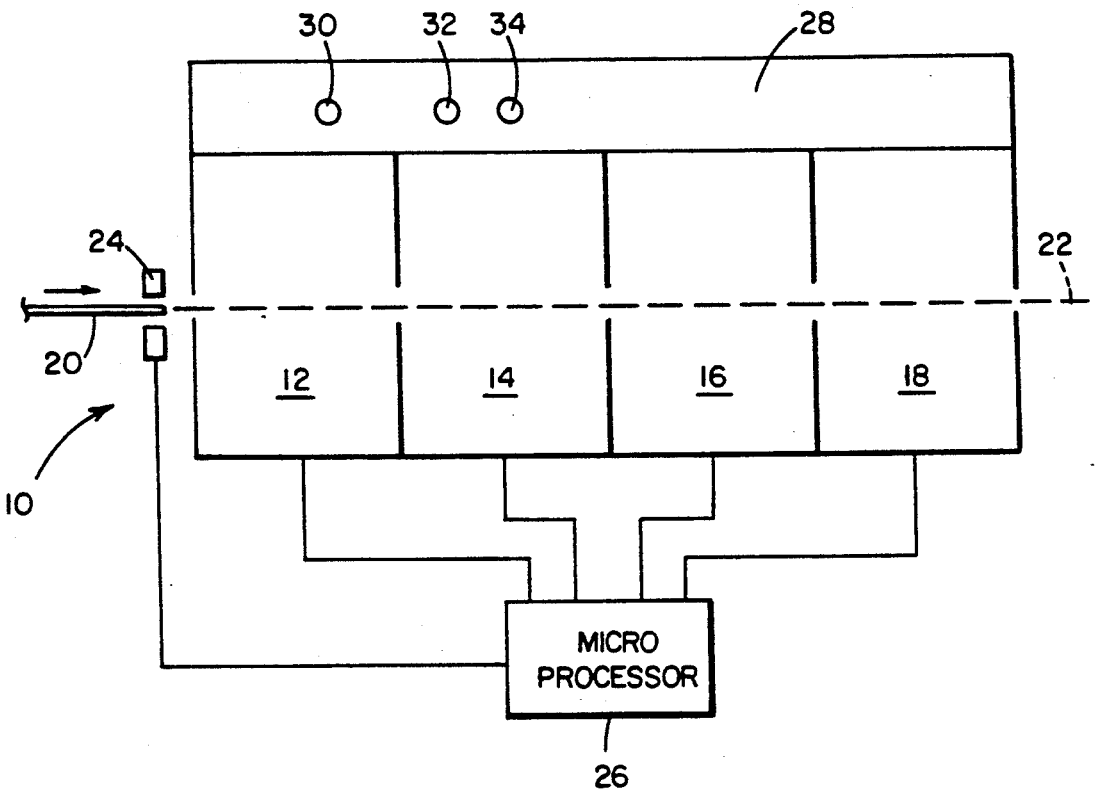
FIG. 1 is a diagrammatic view illustrating portions of a film processor incorporating the invention.

Referring initially to FIG. 1, a processor of the invention is generally designated 10 and comprises a series of processing stations 12, 14, 16 and 18 for processing sheets or strips of photosensitive material, such as x-ray film sheets 20. Film sheet 20 is advanced along a path 22 through the various stations 12–18 for processing latent images on the film and then drying the film. More specifically, station 12 may comprise a developer station wherein a developer solution is applied to the film sheet, and station 14 may comprise a fix station at which a fixer solution engages the film sheet for fixing the developed image. Station 16 may comprise a wash station at which water is directed onto the surface of the film for removing residual fluids from the other station, and station 18 is a dryer station where heated air is directed against the surface of the film for drying the film. Apparatus 10 may be a processor of the kind disclosed in the before-mentioned U.S. Pat. No. 4,994,840.

As the film sheet 20 is fed into the processor, it is detected by one or more film sensors shown at 24. Sensors 24 may comprise a light emitter and detector located on opposite sides of the film path, or the emitter and detector can be located in a common housing on one side of the path with light from the emitter being reflected off of the film sheet into the detector. A signal from the film sensor is provided to a microprocessor 26 which, in turn, is coupled to each of the stations 12–18. The microprocessor senses operating conditions in stations 12–18 and controls operation of apparatus in each of the stations in a programmed manner, as described later.

The processor 10 has a control panel 28 that includes switches and other devices used by the operator for controlling operation of the processor, and lamps and other devices for indicating to an operator various operating conditions of the processor. Thus, three lamps 30, 32 and 34 are shown on the control panel. Lamp 30 is a "ready" lamp which indicates to the operator when it is turned on that the processor is ready for operation so that the operator will know that a sheet 20 of film can be fed into the processor. Lamp 32 is a "wait" lamp which, when turned on, signals the operator to defer temporarily feeding of film into the processor. The wait lamp will be on at times when operating conditions in the stations 12–18, as sensed by the microprocessor indicate that the machine is not operable due to factors that are temporary and not a result of a failure of a portion of the apparatus which requires a service technician. For example, when the processor is initially turned on, the lamp 32 will be turned on if fluids in the various stations are below or above normal operating conditions. These conditions are sensed by the microprocessor and adjusted by, for example, operating a heater in the stations, cooling the solution in the stations, etc. Thus, the wait light is ordinarily on for those conditions that are temporary and can be cured by the normal start-up operation of the processor.

Lamp 34, on the other hand, is a so-called "service" lamp which, when turned on, signals the operator that an error condition exists which requires correction by a service person. As explained in more detail later, the processor of the invention uses the single service lamp 34 to indicate a plurality of error conditions in a way that enables the operator to determine from one lamp the source of the error condition.

Microprocessor 26 receives input information from a number of sensors, including sensors that detect operating conditions in the stations of the processor. The microprocessor also is connected to output devices so that the output devices can be controlled from the microprocessor in accordance with a program stored in the microprocessor. A specific example of the manner in which the microprocessor senses operating conditions in certain parts of the processor and provides a signal related to error conditions to the operator is illustrated in FIG. 2.

Figure 2:
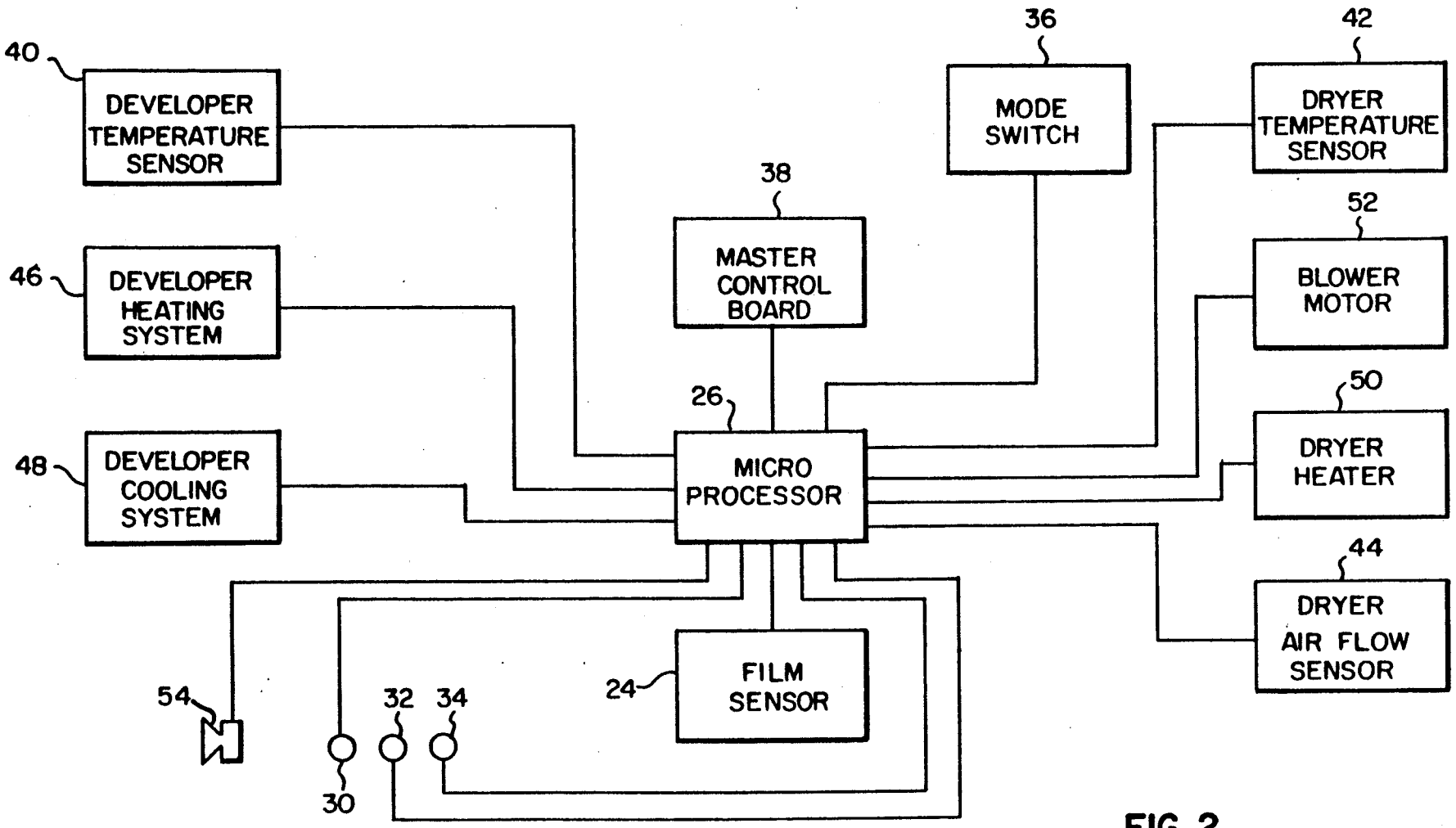
FIG. 2 is a schematic view illustrating in more detail the control system for the processor of the invention.

As illustrated diagrammatically in FIG. 2, the microprocessor receives input information from a master control board 38. Generally, an error condition in the master control board renders the processor inoperative. Therefore, such an error condition has a high priority in terms of providing an error signal to the machine operator. Any error in the master control board ordinarily will not be repaired at the site of the processor but, instead, the board will be replaced.

In the developer station 12, the developer solution is maintained within a range of operating temperatures that enables film to be properly processed. The temperature of the developer fluid is detected by a developer temperature sensor 40 which provides an input signal to the microprocessor indicating the developer temperature at any given time.

In the drying station 18, the temperature of air is detected by a dryer temperature sensor 42 which provides an input signal to the microprocessor indicating the temperature in the dryer. Air is circulated in the dryer to heat and thereby dry the film. Therefore, a dryer air flow sensor 44 is provided for inputting a signal to the microprocessor indicating that air is flowing in the dryer, or that air is not flowing in the dryer. In a similar manner, other sensors (not shown) in stations 12, 14, 16 and 18 provide input signals to the microprocessor so that the microprocessor can determine in accordance with the programmed information stored therein whether the processor is in condition for operation.

Microprocessor 26 also is coupled to output devices for controlling operation of the various stations. For example, the microprocessor is shown connected to a developer heating system 46 and a developer cooling system 48. By controlling operation of the heating system 46 and cooling system 48, the microprocessor can adjust and control the temperature of developer solution in the station 12. The microprocessor also is connected to a dryer heater 50 and to a blower motor 52 in the drying station. This enables the microprocessor to control the temperature of the air being circulated in the dryer and to operate the motor for the blower which circulates air in the drying station. Here, again, similar output devices (not shown) located in the fix station 14 and wash station 16 are under the control of the microprocessor.

As noted previously, the microprocessor is connected to lamps 30, 32 and 34 and it is operative to turn them on or off to indicate a ready condition, a wait condition and a service condition. Preferably, the service lamp 34 is turned on and off, i.e. blinked, in a sequence that signals a particular error code, as explained in more detail hereinafter. If desired, the microprocessor can be connected to an audible annunciator, such as an alarm 54. Preferably, the audible alarm is turned on and off in a sequence or pattern corresponding to the blinking rate of the service lamp 34 to assist the operator in confirming the particular signal being delivered by the microprocessor.

The microprocessor is programmed not only to produce a unique signal for each of the error conditions sensed, but the error conditions preferably are rated and given a priority in the associated software so that the lamp 34 and alarm 54 are turned on and off the fewest number of times for the highest priority error conditions. While the priority arrangement and the particular signalling arrangement can be varied, the following is a preferred embodiment of a signal and priority arrangement that has been found satisfactory for use in a low-cost film processor.

The signal and priority arrangements described below is illustrated in the following table.

| Number of Times Lamp 34 and Alarm 54 are Actuated | Error Condition |
|---|---|
| 1 | Master control board inoperative |
| 2 | Maximum dryer temperature exceeded |
| 3 | Loss of air flow in dryer |
| 4 | Unable to determine developer temperature |
| 5 | Unable to determine dryer temperature |
| 6 | Loss of developer heating ability |
| 7 | Loss of developer cooling ability |
| 8 | Inoperative dryer |

As noted earlier, an error in the master control board preferably is assigned the highest priority error because failure of the control board to operate will ordinarily prevent operation of the processor. Thus, when the microprocessor senses an error in the master control board 38, the microprocessor will blink lamp 34 once and also sound the audible alarm once. After a brief delay the visible and audible signals are repeated. This continues until there is an appropriate response from the operator. Also, when the microprocessor receives a signal from the dryer temperature sensor 42 indicating that the dryer temperature exceeds a predetermined temperature, the microprocessor will blink lamp 34 twice and simultaneously sound the audible alarm 54 twice.

When the loss of air flow in the dryer is determined by a signal from the air flow sensor 44, the microprocessor will blink lamp 34 three times and sound the audible alarm 54 three times. If the microprocessor interrogates the developer temperature sensor 40 but is unable to determine the developer temperature, for example because the sensor is inoperative or there is a faulty connection between the sensor and the microprocessor, then the microprocessor will blink lamp 34 four times and sound the audible alarm 54 four times. Similarly, if the microprocessor is unable to determine the dryer temperature from the dryer temperature sensor 42, the microprocessor will blink lamp 34 five times and sound the audible alarm 54 five times.

If the microprocessor receives a signal from developer temperature sensor 40 indicating that the developer solution needs to be heated or cooled, it sends a signal to the heating system 46 or the cooling system 48. If there is no change in the temperature of the developer sensor after a predetermined time, a loss of the ability of the heating system 46 to heat the solution or a loss of the ability of the cooling system 48 to cool the solution is indicated and the microprocessor blinks lamp 34 six times to indicate loss of the developer heating ability and seven times to indicate loss of the developer cooling ability. Similarly, the microprocessor can determine that an inoperative dryer condition exists by evaluating data received from the dryer temperature sensor 42 and the dryer air flow sensor 44 followed by an attempt to operate the heater 50 to change the temperature or to operate blower 52 to provide air flow in the dryer. If the microprocessor thus determines an inoperative dryer exists, the lamp 34 is blinked eight times and the audible alarm 54 sounded eight times.

Preferably, the signal produced by blinking the lamp 34 or sounding the alarm 54 will be repeated until appropriate action is taken by the operator of the processor. The time interval between each series of blinks defining an error condition is different than the time interval between individual blinks. For example, the time interval between blinks or sounding the alarm for a particular error signal may be approximately 0.5 seconds, while the time interval between successive signalling of the error condition may be approximately 2 seconds. Also, if two or more error conditions exist that require signalling the operator, the signal with the highest priority (lowest in number of blinks as indicated above) will be signalled first. This highest priority signal can be repeated until that error is corrected, followed by the signal for the next higher priority error or, alternatively, the highest priority error can be signalled immediately followed by the next highest priority error, etc., and then the entire sequence of signalling is repeated again.

As explained earlier, when the processor is turned on but not yet ready to process film for some reason, the wait light 32 is turned on by the microprocessor and remains on. If desired, lamp 32 could also be blinked to signal the reason why the processor is not yet ready for operation. For example, if the developer solution is under the desired set point temperature for operation of the processor, the wait lamp 32 could be blinked once to signal this condition. Similarly, the wait light could be blinked twice to signal that the developer solution temperature exceeds the set point temperature. Also, the wait light could be blinked three times to indicate that the dryer temperature is less than the set point temperature, and four times to indicate an error in film detector 24.

In some instances, the number of error codes desired to be signalled to the operator will require a two-digit error code. A two-digit code, such as a code 23, could be signalled by using the single service lamp 34 by blinking the lamp the number of times required to indicate the first digit of the error code number, followed by a time period different than the interval between blinks, and then followed by a number of blinks indicating the second digit of the error code. Thus, for an error code 23, lamp 34 is turned on for 0.5 seconds, then turned off for 0.5 seconds and again turned on for 0.5 seconds. Then the lamp is turned off and remains off for a different period of time, such as two seconds to indicate the end of the first digit of the error code. Then the lamp is turned on three times for 0.5 second intervals separated by two intervals of 0.5 seconds when the lamp is off, thereby indicating the second digit of the error code as three.

The invention has been described in detail with particular reference to a preferred embodiment thereof, but it will be understood that variations and modifications can be effected within the spirit and scope of invention.

I claim:

1. In a processor for developing latent images on a photosensitive material, the processor having at least one processing station wherein a processing solution engages the material and a drying station wherein the material is dried, means for sensing a plurality of operating conditions in the stations and detecting a failure in the operating conditions, and a lamp for signaling error conditions, the improvement comprising:

control means coupled to the lamp and to the sensing means, the control means being effective to turn the lamp on and off one or more times in response to the sensing means detecting failure in the operating conditions, the number of times the lamp is turned on and off being related to the particular failure condition detected by the sensing means, and the control means turning the lamp on and off a different number of times for each of the operating conditions sensed in accordance with a predetermined arrangement.

2. The invention as set forth in claim 1, wherein the control means comprises a programmed microprocessor, and the microprocessor is programmed to signal a plurality of error conditions existing simultaneously in accordance with a predetermined priority arrangement so that the error condition with the highest priority requires the lamp to be turned on and off the least number of times.

3. The invention as set forth in claim 1, wherein the control means comprises a programmed microprocessor, and the microprocessor is programmed to signal two or more errors consecutively in accordance with a predetermined priority arrangement so that the highest priority error is signalled first.

4. In a method for processing latent images on a photosensitive material including the steps of developing the image with a developer solution, fixing the developed image with a fix solution, washing the material to remove processing solution therefrom, drying the material, and sensing a plurality of operating conditions in the developing process to detect failures in the operating conditions, the improvement comprising the steps of:

providing a plurality of signals in response to detecting error conditions with each signal being related to a particular error condition, the signals being provided in a predetermined priority arrangement wherein two or more error conditions are signalled consecutively with the highest priority error being signalled first.

* * * * *